US009314087B2

(12) United States Patent
Ishida

(10) Patent No.: US 9,314,087 B2
(45) Date of Patent: Apr. 19, 2016

(54) LIQUID COSMETIC CONTAINER

(71) Applicant: Yukikazu Ishida, Saitama (JP)

(72) Inventor: Yukikazu Ishida, Saitama (JP)

(73) Assignee: TOKIWA CORPORATION (JP)

( * ) Notice: Subject to any disclaimer, the term of this patent is extended or adjusted under 35 U.S.C. 154(b) by 40 days.

(21) Appl. No.: 14/347,288

(22) PCT Filed: Sep. 19, 2012

(86) PCT No.: PCT/JP2012/073885
§ 371 (c)(1),
(2) Date: Jul. 1, 2014

(87) PCT Pub. No.: WO2013/047280
PCT Pub. Date: Apr. 4, 2013

(65) Prior Publication Data

US 2014/0328611 A1 Nov. 6, 2014

(30) Foreign Application Priority Data

Sep. 27, 2011 (JP) ..... 2011-211457
Sep. 6, 2012 (JP) ..... 2012-195801

(51) Int. Cl.

| | |
|---|---|
| ***A45D 40/26*** | (2006.01) |
| ***A45D 34/04*** | (2006.01) |
| ***A46B 11/00*** | (2006.01) |
| *A45D 40/20* | (2006.01) |

(52) U.S. Cl.

CPC ..... *A45D 40/26* (2013.01); *A45D 34/04* (2013.01); *A46B 11/002* (2013.01); *A46B 11/0041* (2013.01); *A45D 40/20* (2013.01); *A45D 2200/054* (2013.01); *A45D 2200/1072* (2013.01); *A46B 11/0013* (2013.01); *A46B 2200/1046* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,960,340 | A | 10/1990 | Tamiya et al. | |
| 5,172,996 | A | 12/1992 | Tamiya et al. | |
| 6,409,406 | B1 * | 6/2002 | Schwartzman | 401/186 |

FOREIGN PATENT DOCUMENTS

| | | | |
|---|---|---|---|
| DE | 3801674 | A1 | 8/1988 |
| JP | 1987S62027509 | | 2/1987 |
| JP | 1989H01084776 | | 6/1989 |
| JP | 2003072276 | A | 3/2003 |
| JP | 2007042361 | A | 2/2007 |
| JP | 2008039652 | A | 2/2008 |
| JP | 2009285255 | A | 12/2009 |

* cited by examiner

*Primary Examiner* — David Walczak
(74) *Attorney, Agent, or Firm* — Bacon & Thomas, PLLC

(57) ABSTRACT

A liquid cosmetic container wherein the operation portion is provided on side surface of the container body 1. When the operation portion is pressed from the outside, the valve body 5 seating on the valve seat portion 6*a* is moved in the axial direction by the valve pressing portion 6*h* and seats away from the valve seat portion 6*a*, so that the flow path, in which the liquid cosmetic flows, is opened and then, the liquid cosmetic is supplied to the application body 4. Thus, it is not necessary to push the application body into the container 1. Further, the opening/closing of the flow path are performed by moving the valve body 5 in the axial direction by pressing the operation portions from the outside, so that the diameter of the container body 1 can be reduced, comparing with the conventional container.

13 Claims, 15 Drawing Sheets

LIQUID COSMETIC CONTAINER

BACKGROUND OF THE INVENTION

1. Field of the Invention

The present invention relates to a liquid cosmetic container for applying a liquid cosmetic.

2. Description of the Conventional Art

In conventional, in a pencil-type container for applying a liquid, such as a liquid cosmetic, or the like, by an application body, as for a method for supplying the liquid in the container to the application body, the following patent documents 1 and 2 have been known. The patent document 1, i.e., Japanese Utility Model Registration No. 2525538, discusses a method in which a flow path in a container is opened by pushing an application body protruding from the top end of the container into the container, so that the liquid in the container is supplied to the application body.

Further, the patent document 2, i.e., Japanese Utility Model Application Laid-Open No. 62-583, discusses a method in which a movable cork (a valve body) extending in a direction rectangular to an axial direction (a longitudinal direction) of the container body is provided on the side surface of the container body extending in the axial direction, and the movable cork is provided so as to interrupt between a flow path in the top end side and a flow path in a liquid storage side, where a liquid passes. When the movable cork is pushed into the container by a finger, a penetration flow path provided in the movable cork and the above each flow path are connected, and as the result of this, the liquid is supplied to the application body through the flow path in the liquid storage side, the penetration flow path in the movable cork, and the flow path in the top end side.

SUMMARY OF THE INVENTION

Problems to be Solved by the Invention

However, like the patent document 1, when the liquid is supplied to the application body by pushing the application body into the container, there is a problem in which the application body is damaged by the pushing the application body into the container. Further, since there is a necessity of the pushing the application body into the container, particularly, there is a problem that it is difficult to apply this method to an application body having a sharp-shaped top end, an application body made of soft materials, and an application body of a brush type.

Further, like the patent document 2, when the liquid is supplied to the application body by pushing the movable cork into the container, the movable cork moves in the direction rectangular to the axial direction of the container (the direction in which the flow path on the top end side and the flow path on the liquid storage side extend) and connects these flow paths, so that it is necessary to secure a region for this moving and the diameter of the container body is forced to be large. Thus, there is a problem in which compactness of the container cannot be achieved.

Therefore, the present invention is directed to provide a liquid cosmetic container not damaging an application body, applicable to all application body, and further, capable of realizing the compactness of the container body.

Means for Solving the Problems

A liquid cosmetic container according to the present invention includes a container body, an application body, a flow path, an operation portion, a valve seat portion, a valve body, and a valve body pressing portion. The container body includes a storage portion which can store a liquid cosmetic. The application body applies the cosmetic liquid to a part to be applied. The flow path connects the application body and the storage portion in the container body and enables the liquid cosmetic to flow from the storage portion to the application body. The operation portion is provided on the side surface of the container body and pressed from the outside. The valve seat portion is provided in the container body. The valve body is movably provided in the axial direction in the container body, and makes the flow path to be closed by seating on the valve seat portion and to be opened by seating away from the valve seat portion. The valve body pressing portion moves the valve body in the axial direction to be seated away from the valve seat portion when the operation portion is pressed from the outside.

According to the liquid cosmetic container having the above constitution, the operation portion is provided on the side surface of the container body. When the operation portion is pressed from the outside, the valve body seating on the valve seat portion is moved in the axial direction by the valve seat pressing portion and seated away from the valve seat portion, so that the flow path, in which the liquid cosmetic flows, is opened and the liquid cosmetic is supplied to the application body. Thus, since it is not necessary to push the application body into the container, the application body is not damaged and the liquid cosmetic container can be applied to all application body. Further, the valve body is moved in the axial direction by pressing the operation portion from the outside and performs opening/closing of the flow path. Thus, the diameter of the container body can be reduced compared with the conventional container and compactness of the liquid cosmetic container can be realized.

A constitution efficiency performing the above operation is, more specifically, as follows. The valve body includes an enlarged portion to be pressed by the valve body pressing portion. The valve body pressing portion moves the enlarged portion to the direction departing from the valve seat portion by pressing the operation portion from the outside, so that the valve body is seated away.

Further, the following constitution can be also used. The valve body includes an enlarged portion to be pressed by the valve body pressing portion, and the valve body pressing portion moves the enlarged portion to the side of the valve seat portion by pressing the operation portion from the outside, so that the valve body is seated away. In this constitution, when the operation portion is pressed from the outside, the enlarged portion of the valve body is moved to the side of the valve seat portion by the valve body pressing portion, and a liquid cosmetic material between the valve seat portion and the enlarged portion is pressed out to the valve seat portion in which the valve body is seated away. Therefore, the liquid cosmetic material can be supplied more quickly, and the liquid cosmetic container can become a service condition easily.

As for a constitution efficiently performing the above operation, more specifically, the constitution in which the operation portion is made of an elastic material is pointed out. With this constitution, the operability of the operation portion can be increased.

Further, when the container body and the operation portion are integrally molded by two-color molding, the production of the liquid cosmetic container can be easily performed.

Further, when the enlarged portion is a taper portion inclining in the axial direction and moving in the axial direction by pressing to the operation portion, the constitution moving the valve body in the axial direction can be easily realized.

Further, when the taper portion has a mortar shape formed, inclining in the axial direction and the contact surface of the valve pressing portion to the valve body has a taper surface having the same inclination as the taper portion, the movement of the valve body in the axial direction can be more certainly and stably performed.

Further, the constitution, in which an elastic member is provided in the container body and the valve body is urged in the direction in which the valve body seats on the valve seat portion by the elastic member, is pointed out. With this constitution, when there becomes no pressing to the operation portion from the outside, the valve body moves in the axial direction by the urged force and seats on the valve seat portion, so that the flow path can be easily closed.

Effect of the Invention

According to the present invention, the liquid cosmetic container, which does not damage the application body, is applicable to all application body, and further is capable of compactness of the container body, can be realized.

DETAILED DESCRIPTION OF PREFERRED EMBODIMENT

Figure 8:
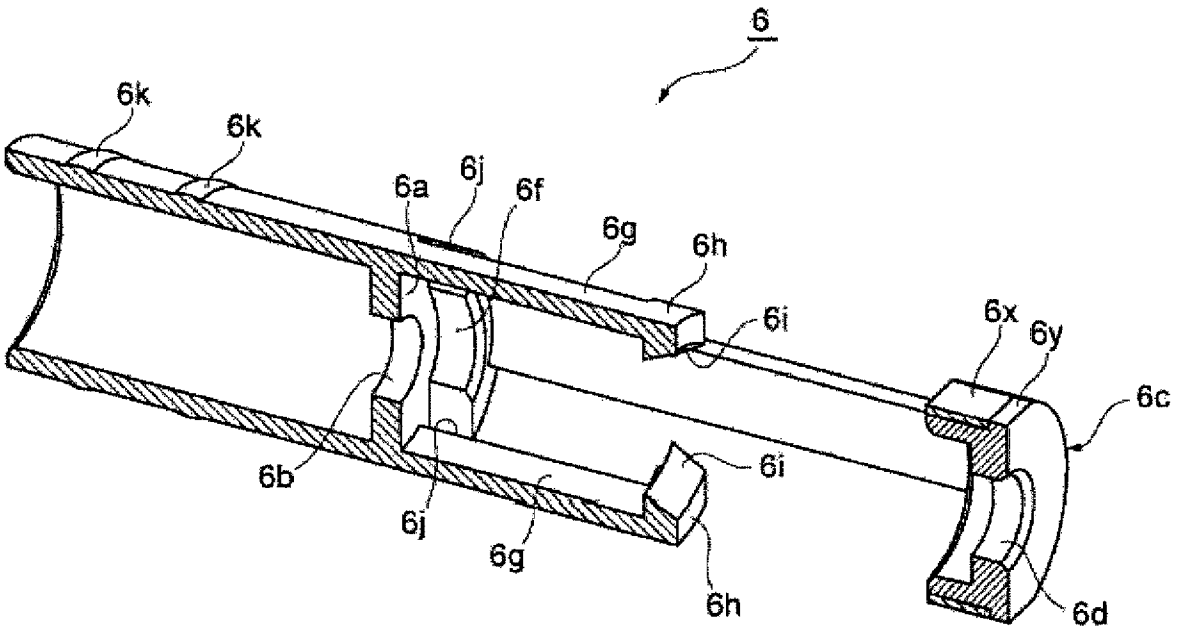
FIG. 8 is a vertical cross-sectional perspective view of the valve seat member illustrated in FIG. 7.
Figure 9:
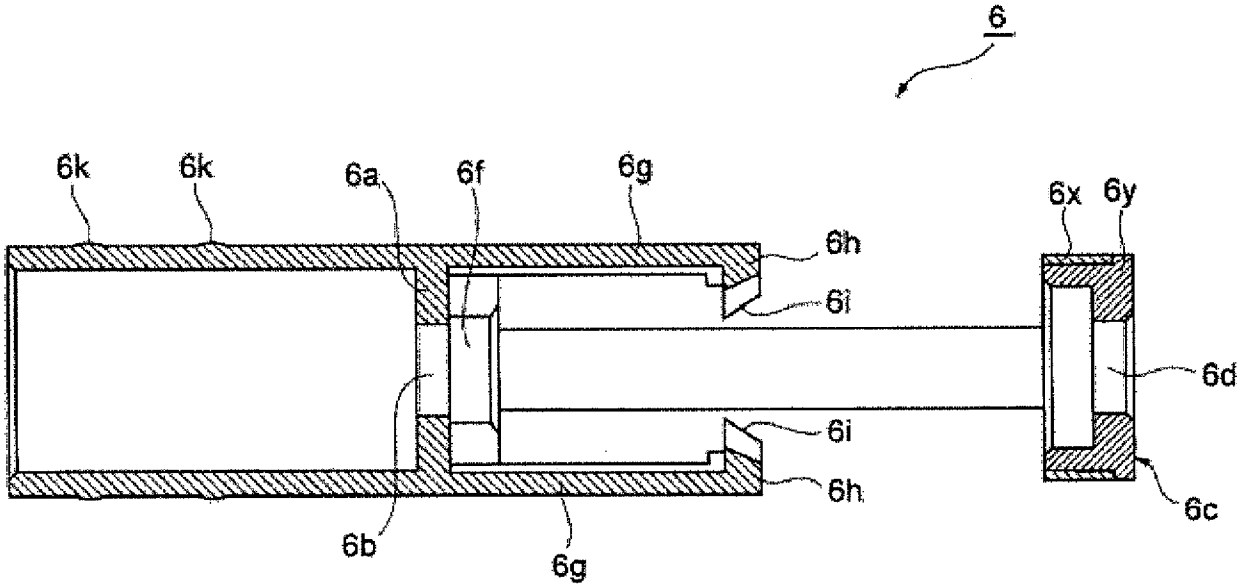
FIG. 9 is a cross-sectional view of the valve seat member in FIG. 8, viewing from the front side.
Figure 10:
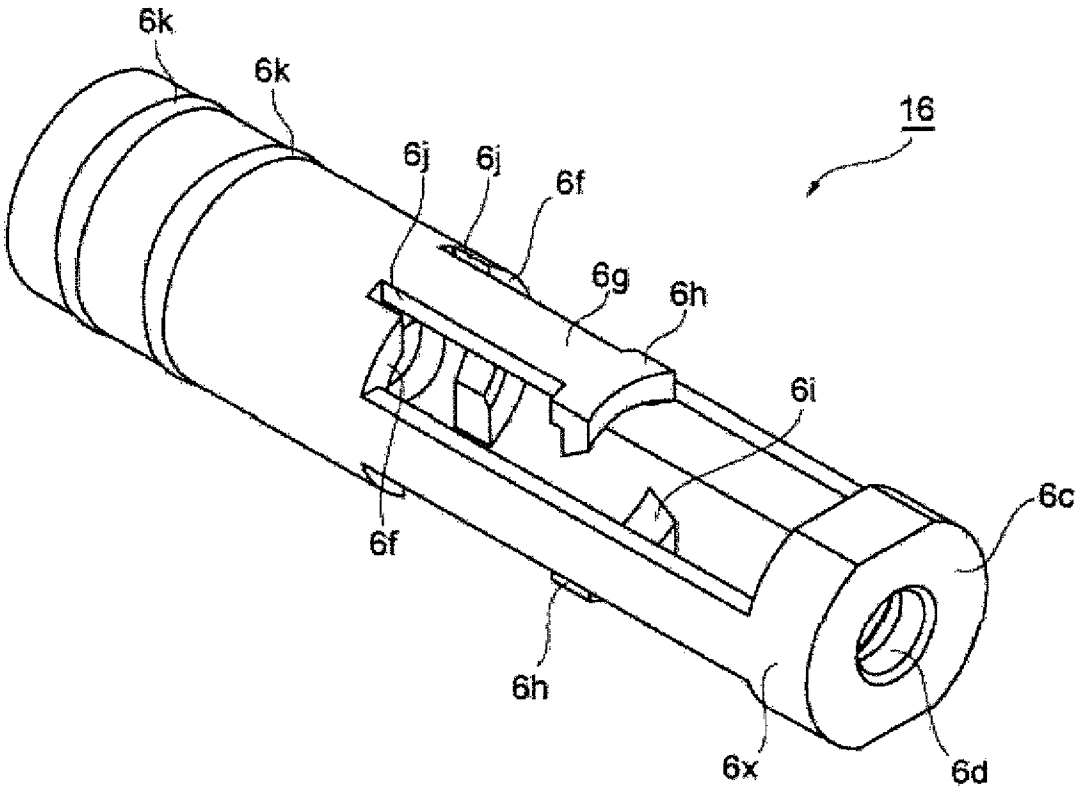
FIG. 10 is a perspective view illustrating a valve seat member of a liquid cosmetic container according to a second exemplary embodiment of the present invention.
Figure 11:
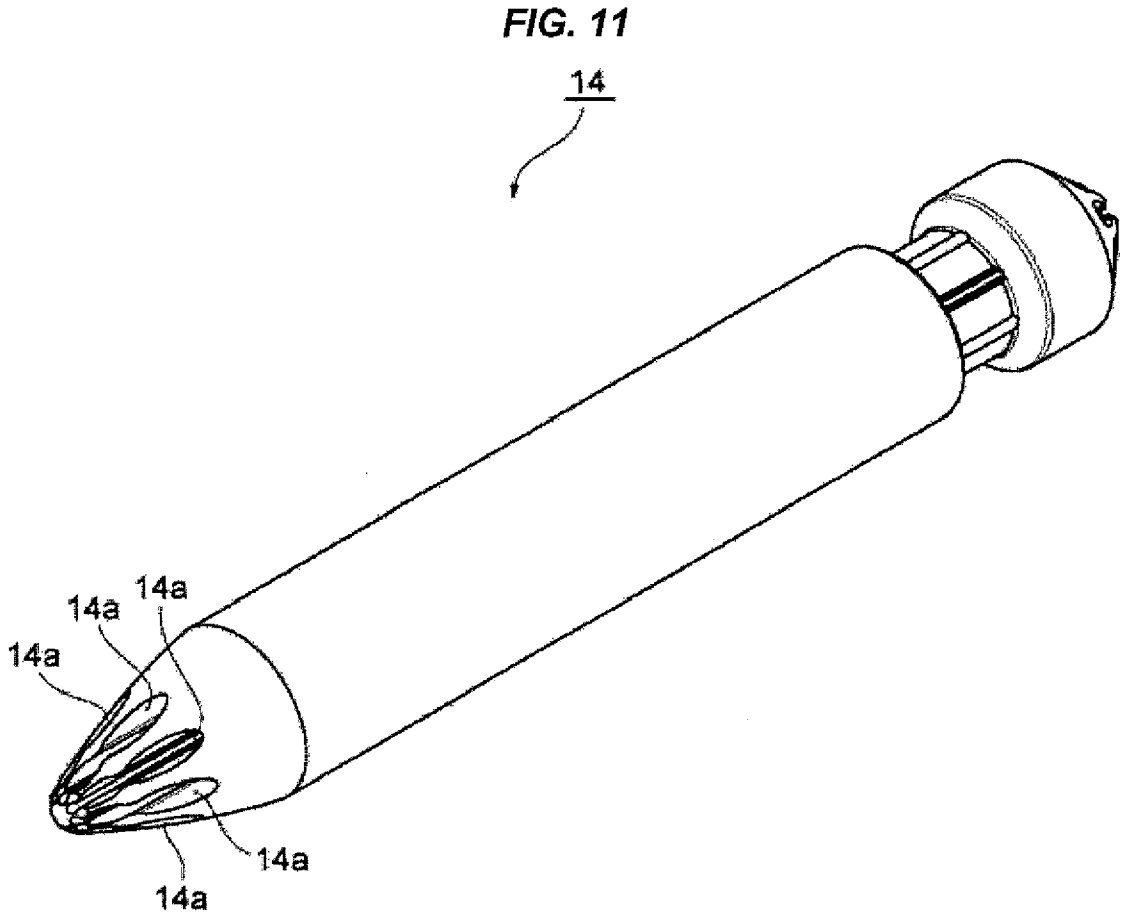
FIG. 11 is a perspective view illustrating an application body of a liquid cosmetic container according to a third exemplary embodiment of the present invention.
Figure 12:
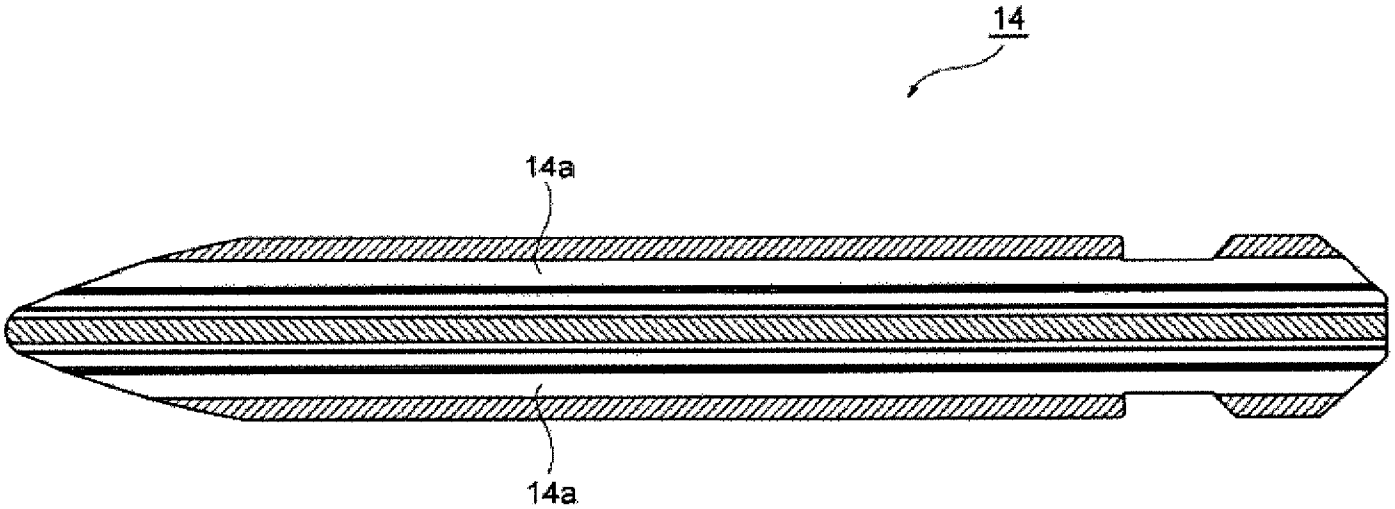
FIG. 12 is a vertical cross-sectional view of the application body illustrated in FIG. 11.
Figure 13:
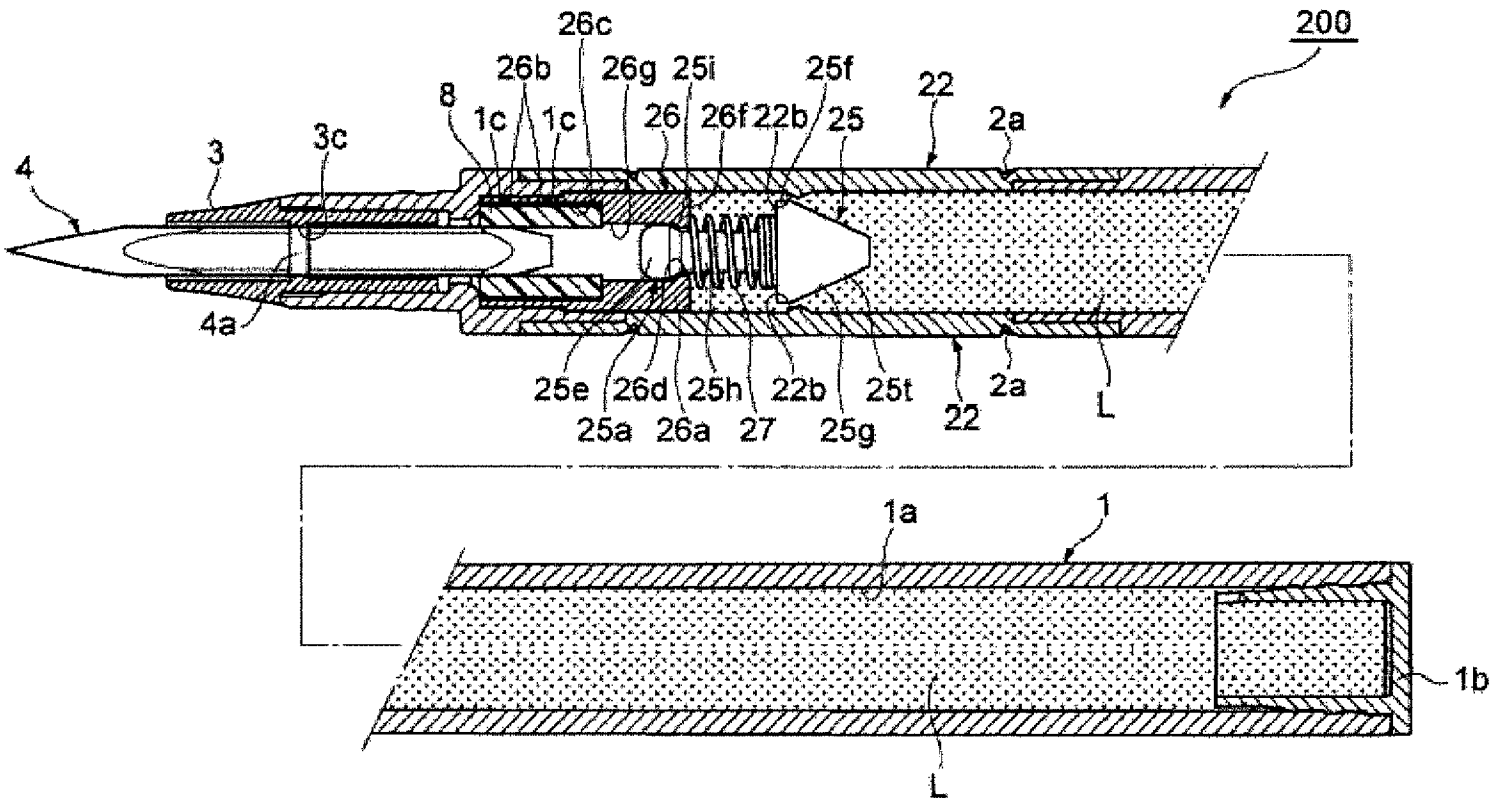
FIG. 13 is a vertical cross-sectional view of a liquid cosmetic container according to a fourth exemplary embodiment of the present invention.
Figure 14:
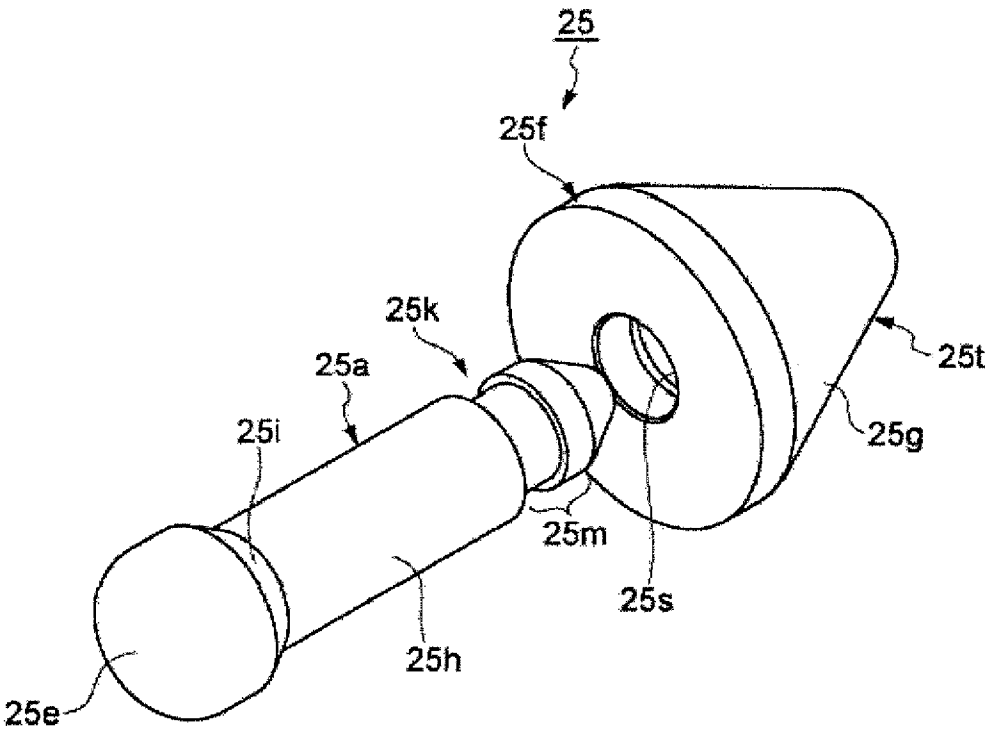
FIG. 14 is a disassembled perspective view illustrating a valve body in FIG. 13.
Figure 15:
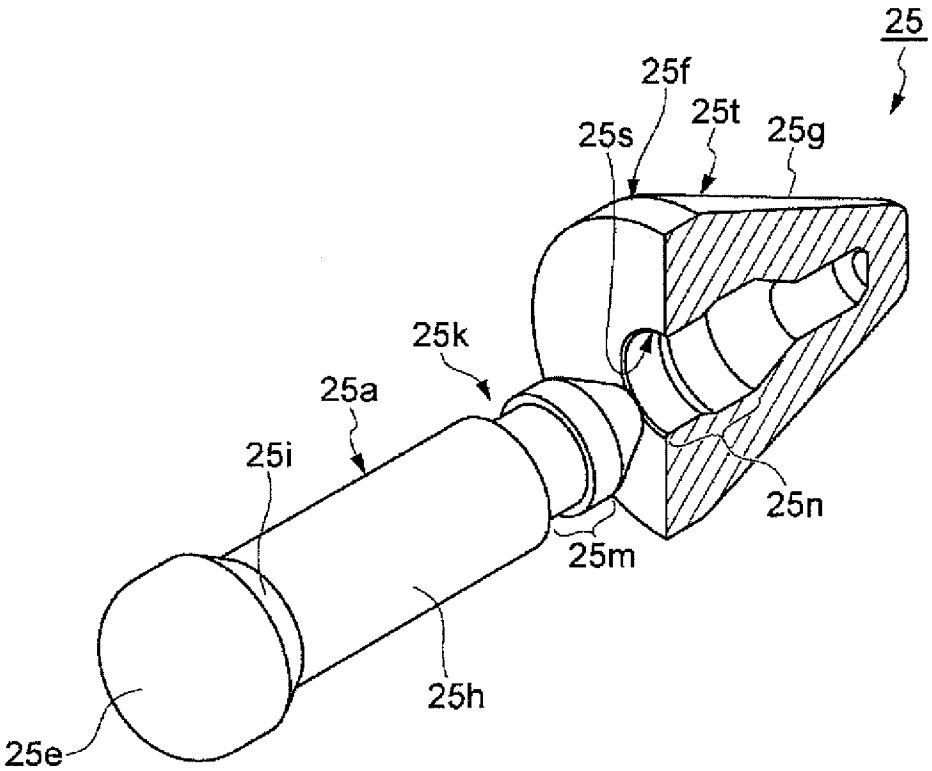
FIG. 15 is a partially cutaway perspective view of FIG. 14.

The preferred exemplary embodiments of the liquid cosmetic container according to the present invention will be described, referring to FIG. 1 to FIG. 15, as follows. FIG. 1 to FIG. 9 illustrate the first exemplary embodiment, FIG. 10 illustrates the second exemplary embodiment, and FIG. 11 and FIG. 12 illustrate the third exemplary embodiment each other. FIG. 13 to FIG. 15 illustrates the fourth exemplary embodiment. In each figure, the same numeral is given to the same element and the overlapped descriptions are omitted.

At first, the first exemplary embodiment illustrated in FIG. 1 to FIG. 9 will be described.

Figure 6:
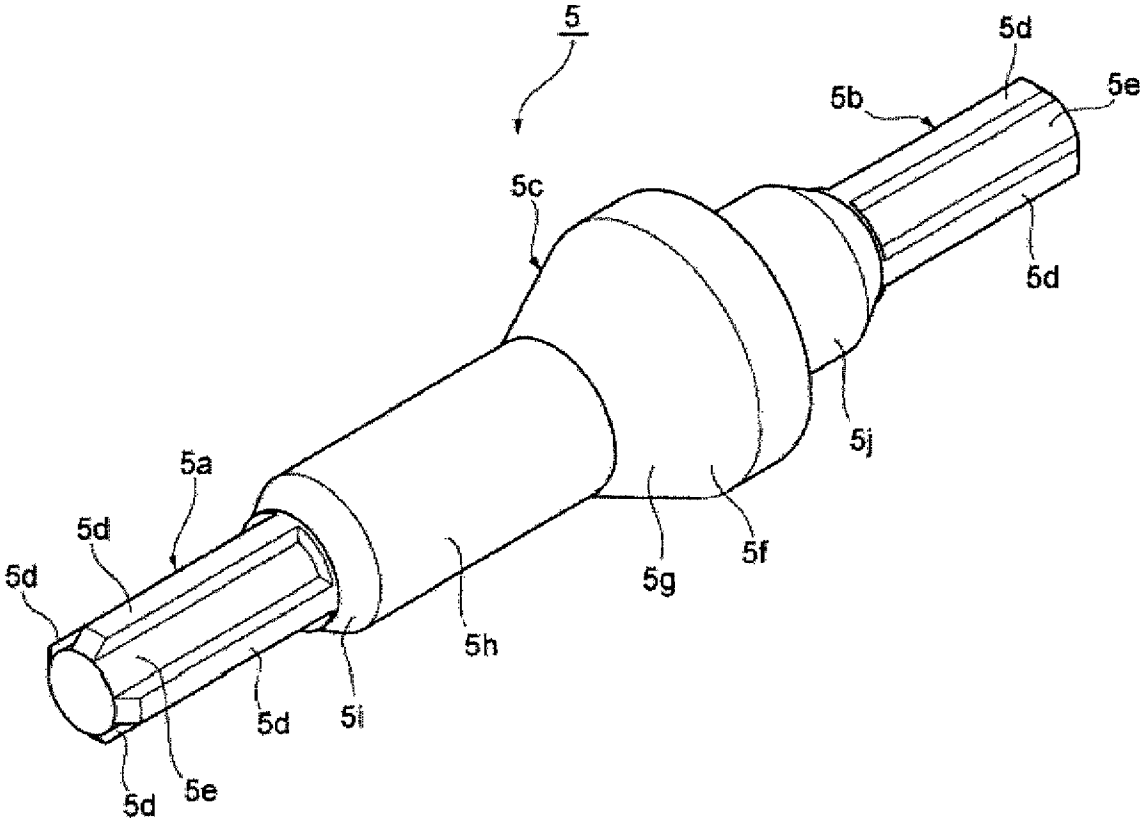
FIG. 6 is a perspective view illustrating the valve body in FIG. 3 to FIG. 5.
Figure 7:
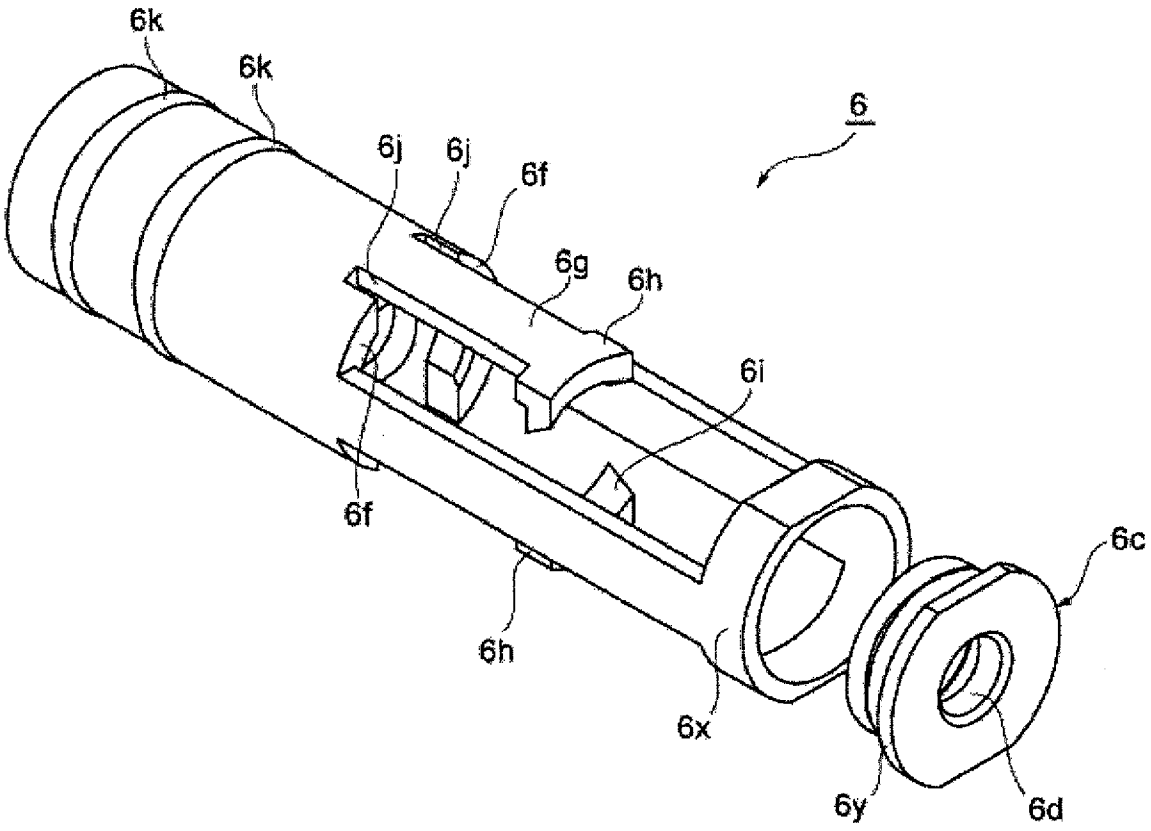
FIG. 7 is a perspective view illustrating the valve seat member in FIG. 3 to FIG. 5.

FIG. 1 to FIG. 5 illustrate the liquid cosmetic container according to the first exemplary embodiment. FIG. 6 illustrates the valve body. FIG. 7 to FIG. 9 illustrate the valve seat member.

Figure 1:
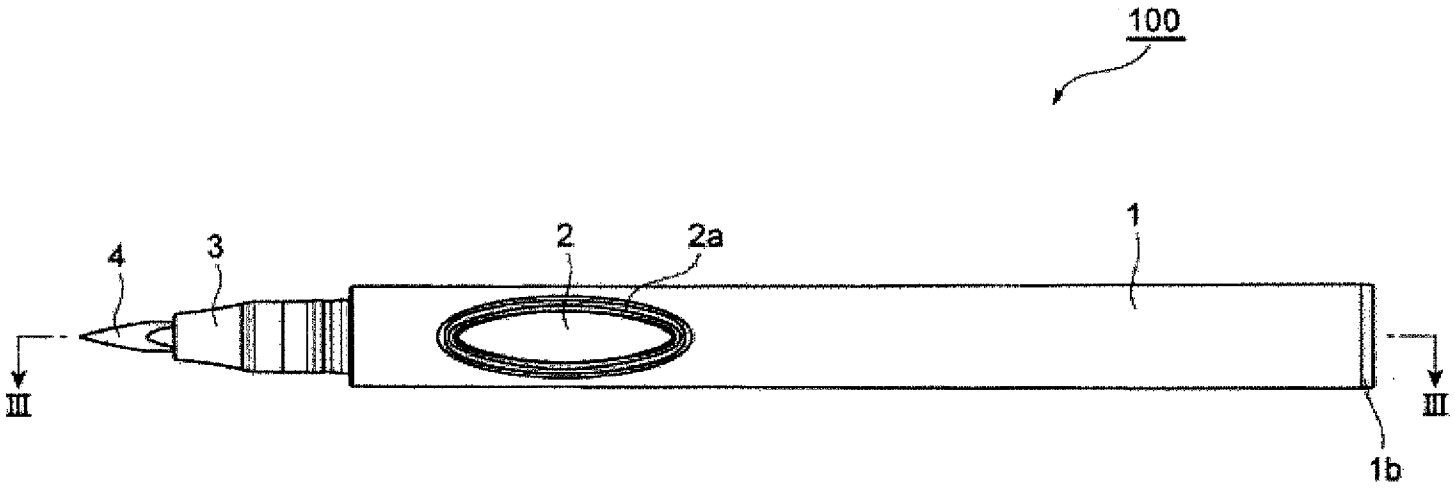
FIG. 1 is a plane view illustrating a liquid cosmetic container according to a first exemplary embodiment of the present invention.
Figure 2:
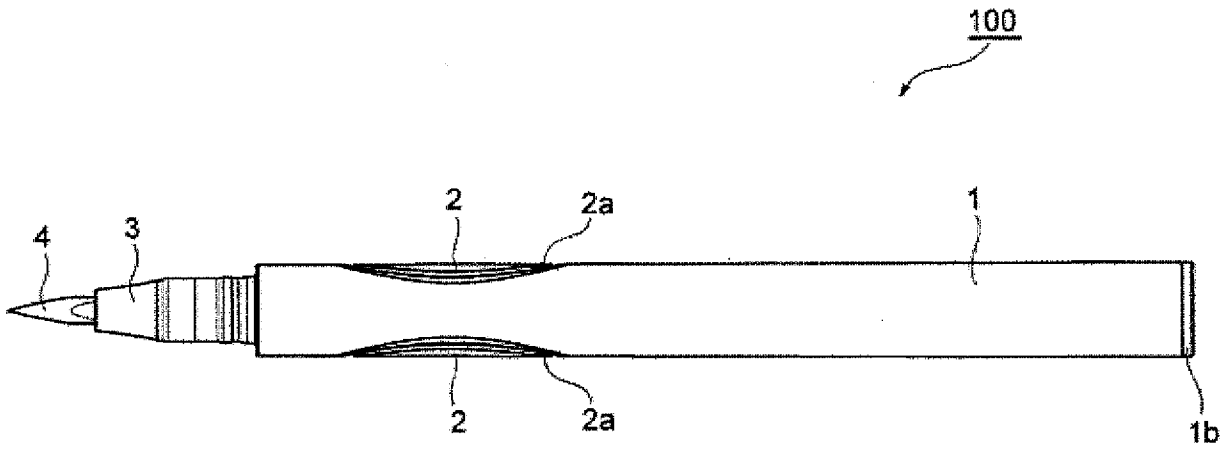
FIG. 2 is a side view of FIG. 1.
Figure 3:
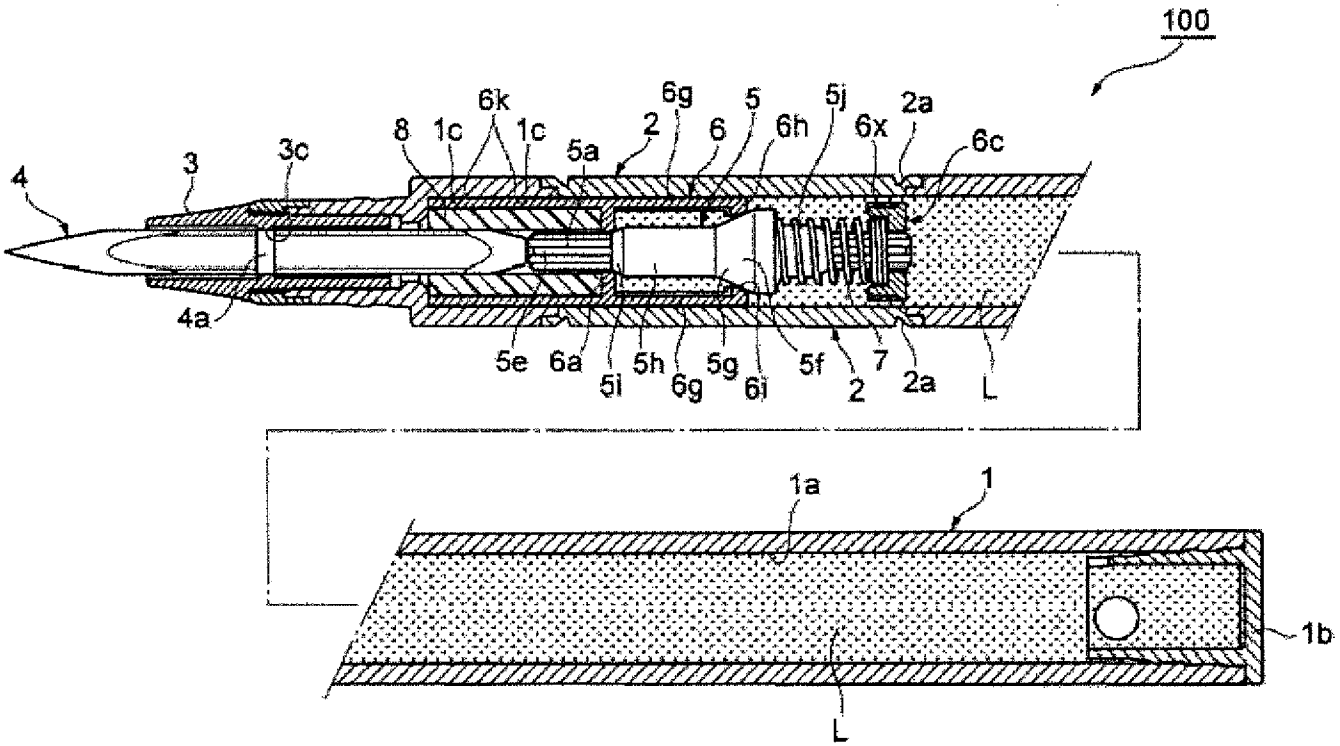
FIG. 3 is a cross-sectional view along a line III-III in FIG. 1.

As illustrated in FIG. 1 to FIG. 3, a liquid cosmetic container 100 has an entirety form of an elongated round bar like writing utensils (a form like a pencil) and a good appearance. For example, the liquid cosmetic container applies an eyeliner liquid, which is a cosmetic, at a hairline of eyelashes and emphasizes the contour of eyes. In addition, the liquid cosmetic container 100 is not limited for the eyeliner liquid and can also be applied for the other liquid cosmetics.

The liquid cosmetic container 100 includes a container body 1, an operation portion 2, an application body 4, and a top end portion 3 as an outline constitution. The container body 1 includes a storage portion 1*a* capable of storing a liquid cosmetic L therein. The operation portion 2 is made of an elastic material and provided on the side surface of the container body 1 so as to enable to be pressed. The application body 4 is provided on the top end side of the container body 1 and applies the liquid cosmetic L to a part to be applied, for example, a skin, or the like. The top end portion 3 is attached to the container body 1 and supports the application body 4.

The container body 1 is constituted so as to expand in the axial direction (the right and left direction in figures) and has a bottomed cylindrical shape in which an end surface of the back side (the right side in figures) is closed by a tail plug 1*b*. As illustrated in FIG. 3, the container body 1 includes the above storage portion 1*a* therein and accommodates a valve seat member 6, a valve body 5, and a spring member (an elastic member) 7. The valve seat member 6 is provided on the front side of the storage portion 1*a*. The valve body moves in the axial direction to the container body 1 and seats away or seats on the valve seat member 6. The spring member 7 urges the valve body frontward.

As for materials of the container body 1, for example, polyethylene terephthalate (PET) or PP, which is a polyester group, is used. Further, transparence materials for checking color and a filling status of the liquid cosmetic L, or materials colored by the color of the liquid cosmetic L, may be used. On an inner circumferential surface of the container body 1, an annular engaging portion 1*c* for engaging the valve seat member 6 in the axial direction is arranged in parallel spaced apart in the axial direction.

As illustrated in FIG. 1 to FIG. 3, the operation portions 2 are formed in an elliptical shape in a plane view extending in the axial direction and provided at a position opposite to the valve body 5 in two equal intervals in the circumferential direction. The operation portions 2 are made of soft materials and, for example, an elastomer or a rubber of an olefin group, a polyester group, or a urethane group can be used. Further, the operation portions 2 include concave portions 2*a* along the circumferential line of the outer circumferential surface. By these concave portions 2*a*, the elasticity in the radial direction of the container body 1 is more increased.

In addition, the operation portions 2 and the above container body 1 are integrally molded by two-color molding.

As illustrated in FIG. 4, and FIG. 7 to FIG. 9, the valve seat member 6 is formed in an approximately cylindrical form extending in the axial direction. In the valve seat member 6, the inner side of the cylinder is divided to two parts, i.e., a right part and a left part illustrated in the figures, by the valve seat portion 6*a* at an approximate center part in the axial direction. At the center part of the valve seat portion 6*a*, an opening 6*b* in which the valve body 5 is inserted in the axial direction is provided. Further, a pair of step part 6*f*, which is a back end surface of the valve seat portion 6*a* and opposed each other in the circumferential direction, is formed. In addition, the step part 6*f* can be omitted.

Further, a pair of opposite portion being an outer wall of the valve seat member 6 in the backside of the valve portion 6*a*, in which the above step parts 6*f* are not provided therein, is cut off along the axial direction and made to be a space in which the inside and the outside are in communication. At the back end surface of the part in which the step parts 6*f* of the valve seat 6*a* are not provide, arm members 6*g* extending to the space in the backside in the axial direction are provided.

At the back end of the arm members 6*g*, valve body pressing portions 6*h* for pressing the valve body 5 are provided. The valve body pressing portions 6*h* is formed to the arm member 6*g*, by which the both end portion in the circumferential direction expands more in the circumferential direction and protrudes to the axial line of the valve seat member 6. Inside surfaces of the valve body pressing portions 6*h* (the surfaces in the axial line side) are made to be a tapered surfaces 6*i* for being in contact with the valve body 5 and pressing. The tapered surfaces 6*i* are formed so as to be inclined to the direction departing from the axial line of the valve member 6 as going from the front end thereof to the back end.

Further, as illustrated in FIG. 7 and FIG. 8, slits 6*j* are provided at a boundary part of the arm member 6*g* and the step portion 6*f*, which is a base part of the arm member 6*g*. The slit 6*j* are formed to extend in the axial direction so as to reach the valve seat portion 6*a* and communicates the inside and the outside of the valve member 6.

Like this structure, since the arm members 6*g* extend backward by cantilevered supporting and the slit portions 6*j* are formed at the base part of the arm members 6*g*, the elastic force of the arm member 6*g* in the radial direction is enhanced, so that displacement in the radial direction can be easily obtained.

Further, the valve seat member 6 includes a back end annular portion 6*x* which is annularly formed around the axis line, at the back end thereof. To the back end annular portion 6*x*, a spring support portion 6*c* for supporting a spring member 7 is detachably provided.

The spring support member 6*c* is formed approximately cylindrical shape in its entirety. The spring support member 6*c* has a hole portion 6*d*, for which the back end of the valve body 5 is inserted and penetrated, at the center thereof and includes a flange portion 6*y* at the end part thereof. Further, a radius of the outer circumferential surface of the circular annular portion positioned on the front side of the flange portion 6*y* of the spring support portion 6*c* is made to be an insertion portion having a radius a little smaller than the radius of the inner circumferential surface of the back end annular portion 6*x*. The spring support portion 6*c* is inserted from the front side thereof to the back end annular portion 6*x* and the front end surface of the flange portion 6*y* becomes in contact with the back end surface of the back end annular portion 6*x* to be attached so as to close the back end annular portion 6*x*.

Figure 4:
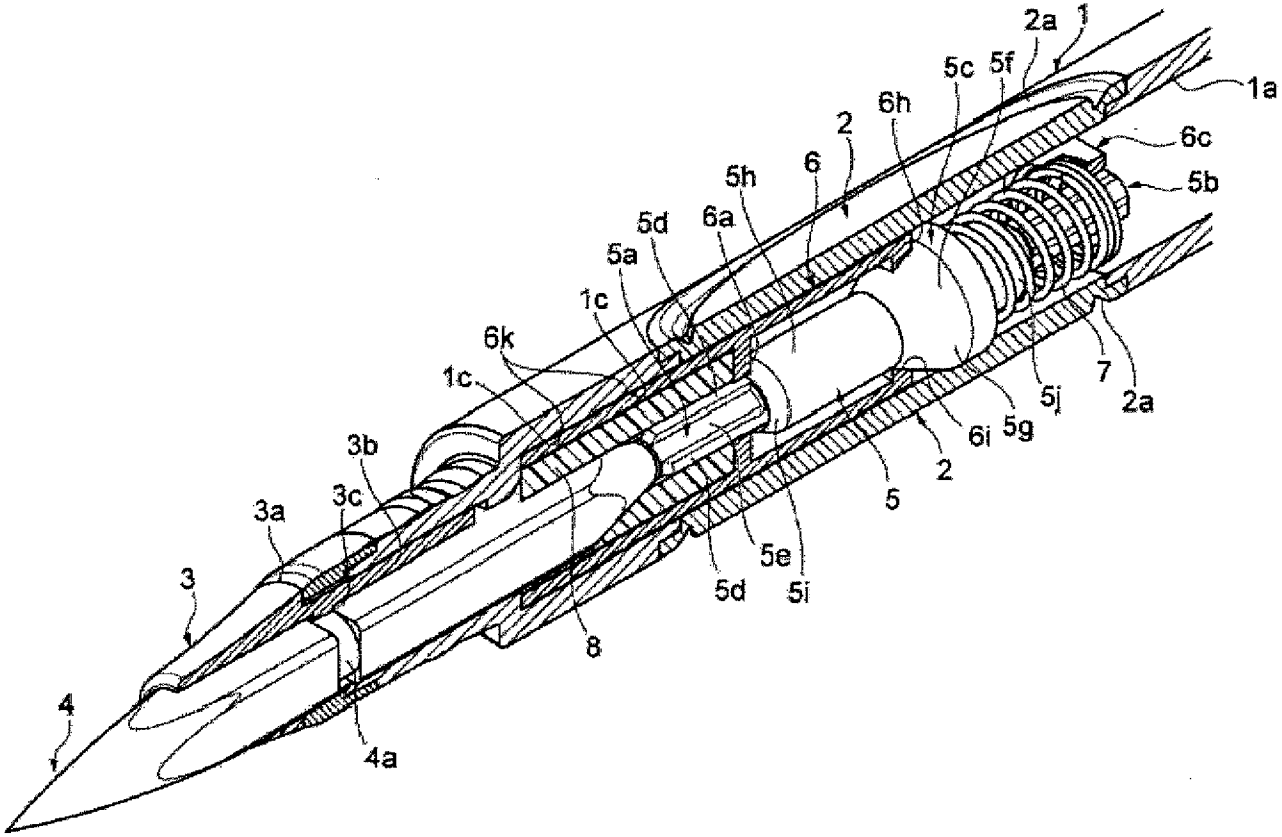
FIG. 4 is a vertical cross-sectional perspective view illustrating an essential part of the liquid cosmetic container illustrated in FIG. 1.

Further, on the outer circumferential surface on the front side from the valve seat portion 6*a* in the valve member 6, a pair of annular convex portions 6*k* to be engaged to the annular engagement portion 1*c* of the container body 1 in the axial direction is provided with spaced apart. As illustrated in FIG. 3 and FIG. 4, the valve seat member 6 is inserted in the container body 1 and the annular convex portion 6*k* is engaged with the annular engaging portion 1*c* of the container 1 in the axial direction, so that the valve seat member 6 is attached to the container body 1 unmovable in the axial direction.

Further, in a space on more front side than the valve seat portion 6*a* at the inside of the valve seat member 6, a cylindrical holding member 8 for holding a liquid cosmetic L is filled so as to cover the inner circumferential surface of the valve seat member 6. As the holding member 8, for example, a sponge made of polyurethane, a pipe-like inner cotton, or an adjuster in which plural annular panels are provided in parallel so as to be overlapped in the axial direction, can be used. The adjuster having the overlapped annular panels is configured to have a bellows-shaped groove with the overlapped annular portion. In the groove, the liquid cosmetic L is held with a capillary phenomenon. The holding member 8 can hold the liquid cosmetic L, so that the suitable amount of the liquid cosmetic delete L can flow into the application body 4.

As illustrated in FIG. 4 and FIG. 6, the valve body 5 includes a front side shaft portion 5*a* and back side shaft portion 5*b*, which are formed in an approximately cylindrical shape and extending in the axial direction, and a core portion 5*c* between these shaft portions 5*a* and 5*b*.

The front side shaft portion 5*a* and the back side shaft portion 5*b* include a plurality of ridges 5*d* extending in the axial direction on the circumferential surfaces (in this case, 5 ridges). By forming these ridges, concave grooves 5*e* for making the liquid cosmetic L to flow are formed between these ridges 5*d* and 5*d*, extending in the axial direction.

As illustrated in FIG. 6, the core portion 5*c* includes a taper portion 5*f*. The taper portion 5*f* is formed in the shape of mortar inclining in the axial direction so as to make the diameter to gradually expand as going from the front end to the backside. The taper portion 5*f* includes a taper surface 5*g* for being in contact with a taper surface 6*i* of the valve body pressing portion 6*h*. The taper surface 5*g* is formed to be inclined in the axial direction so as to make the diameter gradually expand as going from the front end to the back end. The inclination angle of the taper surface 5*g* is the same as the inclination angle of the taper surface 6*i*.

Further, a front side shaft 5*h* is between the taper portion 5*f* and the front side shaft portion 5*a*, and a backside shaft 5*j* is between the taper portion 5*f* and the backside shaft portion 5*b*.

The front side shaft 5*h* includes a taper surface 5*i*, on the top end thereof, for opening/closing the opening portion 6*b* of the valve seat portion 6*a*. The taper surface 5*i* is formed so as to expand the diameter as going from the front end to the back end.

Further, the backside shaft 5*j* winds a spring member 7 thereon.

As illustrated in FIG. 3 and FIG. 4, the valve body 5 is inserted in the container body 1, the front side shaft portion 5*a* enters the back half portion of the holding member 8, and the backside shaft portion 5*b* inserts and penetrates the hole portion 6*d* of the spring supporting portion 6*c*.

Figure 5:
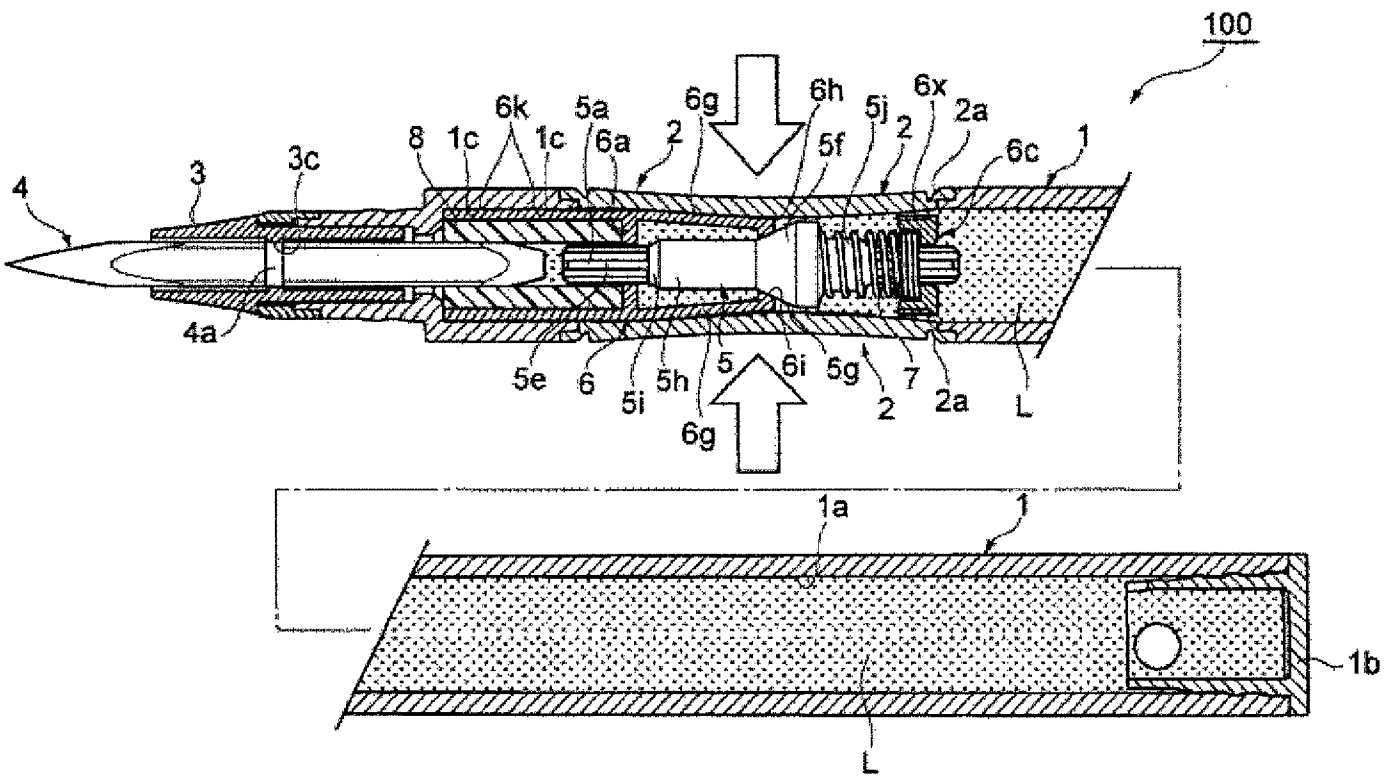
FIG. 5 illustrates the state in which the operation portion of the liquid cosmetic container illustrated in FIG. 3 is pressed.

As illustrated in FIG. 3 to FIG. 5, in the spring portion 7, one end (the front end) is fixed and supported at the back end of the taper portion 5*f* and another end (the back end) is fixed and supported at the spring supporting portion 6*c* of the valve seat member 6. By this spring member 7, the valve body 5 is urged frontward, and the taper surface 5*i* is seated on the valve seat portion 6*a*, so that the taper surface 5*g* becomes the state in contact with the taper surface 6*i*.

As illustrated in FIG. 4, the top end portion 3 is constituted to have a stepped cylindrical shape having a step portion 3*a* on the outer circumferential surface of the middle part in the axial direction. A cylindrical portion being more back side than the step portion 3*a* is an insertion portion 3*b* to be inserted in the container body 1. On the inner circumferential surface of the insertion portion 3*b*, an annular convex portion 3*c* for supporting the application body 4 is provided. In addition, the annular convex portion 3*c* can be provided at any places, if the application body 4 can be supported, not limiting the inner circumferential surface of the insertion portion 3*b*.

In the top end portion 3, the insertion portion 3*b* is inserted in the top end side of the container body 1, the step portion 3*a* is impinged to the top end surface of the container body 1, and the engaging portions of the outer circumferential surface of the insertion portion 3*b* and the inner circumferential surface of the container body 1 are engaged each other in the axial direction, so that the top end portion 3 is attached to the container body 1 unmovable in the axial direction. In addition, the top end portion can be integrally formed with the container body 1.

The application body 4 is a bundle of fibers formed to be a rod extending in the axial direction and is made of, for example, polyester. The application body 4 includes, at a middle part of the axial direction, an annular concave portion 4*a* to be engaged with the annular convex portion 3*c* of the top end portion 3 in the axial direction. The application body 4 is inserted in the top end portion 3, the back end part of the application body enters the front half portion of the holding member 8, and the annular concave portion 4*a* engages with the annular convex portion 3*c*, so that the application body 4 is attached to the top end portion 3 unmovable in the axial direction. In this state, the application body protrudes frontward and in the outside from the top end of the top end portion 3.

An operation in the liquid cosmetic container 100 constituted with the above structure will be described as follows. As illustrated in FIG. 3, in a state in which the operation portion 2 is not pressed from the outside, the taper surface 5*g* of the valve body 5 is in contact with the taper surface 6*i* of the valve pressing portion 6*h* by the urged force of the spring member 7, and the taper surface 5*i* is in contact with the valve seat portion 6*a* to close the opening 6*b*, so that the state in which the valve body 5 seats on the valve seat portion 6*a* is realized.

Then, an operator has the container body 1 with one hand like to have writing utensils and presses the each operation portion 2 from the outside by, for example, the thumb and the index finger. Then, corresponding to the pressing, as illustrated in FIG. 5, the valve body pressing portion 6*h* falls inside at the base of the arm member 6*g* as a fulcrum to change the position, so that the valve body pressing portion 6*h* presses the taper portion 5*f*. By this operation, the taper surface 5*g* of the valve body 5 moves backward with respective to the taper surface 6*i*, and the taper surface 5*i* is separated from the valve seat portion 6*a* to open the opening 6*b*, so that the valve body 5 seats away from the valve seat portion 6*a*. By these processing, the liquid cosmetic L existing in the backside of the valve seat portion 6*a* moves frontward through a plurality of the concave grooves 5*e*, which is positioned on front side of the front side shaft 5*h* having the taper surface 5*i* at the top end thereof, enters on the holding member 8 side, and is supplied to the holding member 8 and the application body 4. Then, the application body 4 absorbs the liquid cosmetic L on the top end side by a capillary action and can apply the liquid cosmetic L from the top end thereof.

Further, when the user releases the pressing to the operation portions 2 by releasing the fingers, the operation portions 2 are resorted to the original position by their elasticity. As illustrated in FIG. 3, by this restoration, the valve body pressing portion 6*h* moves to the outside by the urging force of the spring member 7 and returns to the original position to release the pressing force of the valve body pressing portion 6*h* to the taper portion 5*f*. As the result of this, the taper surface 5*g* frontward moves on the taper surface 6*i*, and the taper surface 5*i* becomes in contact with the valve seat portion 6*a* to close the opening 6*b*, so that the valve body 5 seats on the valve seat portion 6*a*. By this processing, the flow path between the application body 4 and the storage portion 1*a* of the container body 1 is closed and supplying the liquid cosmetic L to the holding member 8 and the application body is stopped.

As described above, according to the liquid cosmetic container 100 of the present invention, the operation portions 2 are provided on the side surface of the container body 1. When the operation portions 2 are pressed from the outside, the valve body 5 seating on the valve seat portion 6*a* moves in the axial direction by the valve pressing portion 6*h* and seats away from the valve seat portion 6*a*, the flow paths, in which the liquid cosmetic L flows, are released, and the liquid cosmetic L is supplied to the application body 4. More specifically, when the operation portion 2 is pressed from the outside, the taper portion 5*f* of the valve body 5 is moved to the direction departing from the valve seat portion 6*a* by the valve body pressing portion 6*h*, and the valve body 5 is seated away from the valve seat portion 6*a*. Then, the flow path in which the liquid cosmetic L flows opens, so that the liquid cosmetic L is supplied to the application body 4. Therefore, since there is no need to press the application body into the container, the application body is not damaged, and the liquid cosmetic container 100 is applicable to all application body containing a very soft application body. Further, since the valve body 5 moves in the axial direction by the pressing from the outside to the operation portions 2 and opening/closing of the flow paths is performed, the diameter of the container body 1 can be reduced, comparing with the conventional container, so that the compactness of the liquid cosmetic container can be realized.

Further, in the liquid cosmetic container 100, since the operation portions 2 are made of an elastic body, the operability of the operation portions 2 can be increased.

Further, since the container body 1 and the operation portion 2 is integrally molded by two-color molding, the production of the liquid cosmetic container can be easily performed, comparing with the conventional container.

Further, since the valve body 5 has the taper surface 5*g* which inclines in the axial direction and moves in the axial direction by the pressing to the operation portions 2, the constitution making the valve body 5 to move in the axial direction can be easily realized. Furthermore, the taper portion 5*f* of the valve body 5 has a mortar shape formed inclining in the axial direction and the contact surface of the valve body pressing portion 6*h* to the valve body 5 is made to be the taper surface 6*i* having the same inclination as the taper surface 5*g* of the taper portion 5*f* of the valve body 5. Thus, the movement of the valve body in the axial direction can be more certainly and stably performed.

Further, the spring member 7 is provided in the container body 1 and the valve body 5 is urged in the direction, in which the valve body 5 seats on the valve seat portion 6*a*, by the spring member 7. Thus, when there becomes no pressing from the outside to the operation portion 2, the valve body 5 moves in the axial direction (frontward) by the urging force by the spring member 7 and seats on the valve seat member 6. Accordingly, the flow paths of the liquid cosmetic L to the application body 4 can be easily closed.

Further, in the present exemplary embodiment, the user can easily make the liquid cosmetic container 100 to be a usable state by only pressing the operation portion 2 by his one hand. Further, by the pressing to the operation portion 2, the infiltration amount of the liquid cosmetic L to the application body 4 can be easily adjusted.

In addition, in the present exemplary embodiment, as the particularly preferable exemplary embodiment, the container body 1 and the operation portion 2 are integrally molded by two-color molding. However, the molding method is not limited. For example, the operation portion 2 can be molded to the container body 1 molded beforehand by insert-molding.

FIG. 10 is a perspective view illustrating a valve seat member 16 of a liquid cosmetic container according to a second exemplary embodiment of the present invention.

The different point of the liquid cosmetic container in the second exemplary embodiment from the liquid cosmetic container 100 in the first exemplary embodiment is that the spring supporting portion 6*c* of the valve seat member 6 is integrally formed with the back end annular portion 6*x*.

Also in such the second exemplary embodiment, the similar operation/effect as the first exemplary embodiment can be achieved and in addition, the number of the parts can be reduced.

FIG. 11 is a perspective view illustrating a liquid cosmetic container according to a third exemplary embodiment of the present invention. FIG. 12 is a vertical cross-sectional view illustrating an application body in FIG. 11.

The different point of the liquid cosmetic container in the third exemplary embodiment from the liquid cosmetic container 100 in the first exemplary embodiment is that an application body 14 having flow paths 14*a*, in which the liquid cosmetic L flows, are used instead of the application body 4.

The flow paths 14*a* of the application body 15 extend in the axial direction and, for example, 8 paths are provided on the circumferential direction having equal intervals. Like this constitution, the flow paths 14*a* penetrate in the axial direction and are provided two or more, so that feeding of the liquid cosmetic to the application body 14 can be accelerated more and can make the liquid cosmetic container to be the usage state more easily.

FIG. 13 is a vertical cross-sectional view of a liquid cosmetic container according to a fourth exemplary embodiment of the present invention. FIG. 14 is a disassembled perspective view illustrating a valve body in FIG. 13. FIG. 15 is a partially cutaway perspective view of FIG. 14.

The different point of a liquid cosmetic container 200 in the fourth exemplary embodiment from the liquid cosmetic container 100 in the first exemplary embodiment is as follows. An operation portion 22 having a projecting valve body pressing portion 22*b* on an inner surface thereof is used instead of the operation portion 2. A valve body 25 pressed by the valve body pressing portion 22*b* to move frontward is used instead of the valve body 5 pressed by the valve body pressing portion 6*h* to move backward. A valve seat member 26 having a valve seat portion 26*a* at a back end portion thereof is used instead of the valve seat member 6. A spring member 27 urging the valve body 25 backward is used instead of the spring member 7 urging the valve body 5 frontward.

The different point of the operation portion 22 from the operation portion 2 is only that the operation portion 22 has the valve body pressing portion 22*b*, and the other configuration of the operation portion 22 is similar to the configuration of the operation portion 2. The projecting shape of the valve body pressing portion 22*b* is a cross-sectional mountain shape.

As illustrated in FIG. 13, the valve seat member 26 is formed in a stepped cylindrical shape extending in the axial direction, and has the valve seat portion 26*a* at the back end thereof. The valve seat portion 26*a* has an opening 26*d* at a central portion thereof, and the valve body 25 is inserted into the opening 26*d* in the axial direction. Further, a back end surface of the valve seat portion 26*a* is a spring supporting portion 26*f* for supporting one end of the spring member 27. Further, a portion on more front side than the valve seat portion 26*a* in the valve seat member 26 is an enlarged diameter hole portion 26*g*, which has a hole with a diameter more enlarged than the opening 26*d*. Further, an enlarged diameter hole portion 26*c* is provided on the front side of the enlarged diameter hole portion 26*g*, and the enlarged diameter hole portion 26*c* has a hole with a diameter more enlarged than the enlarged diameter hole portion 26*g* and stores the holding member 8. The holding member 8 is stored in the enlarged diameter hole portion 26*c*. On an outer circumferential surface of the enlarged diameter hole portion 26*c*, a pair of annular projecting portions 26*b* to be axially engaged with the annular engaging portion 1*c* of the container body 1 is provided, separating each other in the axial direction. The valve seat member 26*b* is inserted into the container body 1, and the annular projecting portions 26 are axially engaged with the annular engaging portion 1*c* of the container body 1, so that the valve seat member 26 is attached to the container body 1 unmovably in the axial direction.

As illustrated in FIG. 13 to FIG. 15, the valve body 25 includes a bar-shaped member 25*a* formed in a round bar shape extending in the axial direction, and an enlarged diameter portion 25*f*, which is integrated with a back end portion of the bar-shaped member 25*a* and has a diameter more enlarged than the bar-shaped member 25*a*.

The enlarged diameter portion 25*f* includes a taper portion 25*t*. The taper portion 25*t* has a mortar shape formed inclining in the axial direction so as to make the diameter gradually decrease as going backward from the front end. The taper portion 25*t* includes a taper surface 25*g* to be in contact with the valve body pressing portion 22*b* of the operation portion 22. The inclination angle of the taper surface 25*g* is the same as the inclination angle of the valve body pressing portion 22*b*. Further, an insertion hole 25*s* for inserting and attaching the bar-shaped member 25*a* is formed at a front end of the enlarged diameter portion 25*f* so as to extend partway. The insertion hole 25*s* has an annular uneven portion 25*n* in which annular projecting and concave portions are axially provided in parallel.

The bar-shaped member 25*a* includes a head portion 25*e* on the front end side thereof, a central portion 25*h* formed extending axially to have the smaller diameter than the head portion 25*e*, and a back end portion 25*k* on an outer circumferential surface thereof. In the back end portion 25*k*, an annular uneven portion 25*m* in which annular projecting and concave portions are axially provided in parallel is provided so as to be axially engaged with the annular uneven portion 25*n* of the enlarged diameter portion 25*f*. Between the head portion 25*e* and the central portion 25*h*, a taper surface 25*i* formed inclining in the axial direction so as to make the diameter gradually decrease as going from the front end to the back end. The taper surface 25*i* is to open/close the opening 26*d* of the valve seat portion 26*a*. Further, the bar-shaped member 25*a* is pressed into the enlarged diameter portion 25*f*, and the annular uneven portion 25*m* of the back end portion 25*k* of the bar-shaped member 25*a* is engaged with the annular uneven portion 25*n* of the enlarged diameter portion 25*f*. Therefore, the bar-shaped member 25*a* is integrally attached to the enlarged diameter portion 25*f* unmovably in the axial direction. Further, the spring member 27 is wound around the central portion 25*h*.

As illustrated in FIG. 13, the spring member 27 is in a state that one end (front end) is fixed and supported by the spring supporting member 26*f* of the valve seat member 26, and another end (back end) is fixed and supported by the front end of the enlarged diameter portion 25*f*. The spring member 27 urges the valve body 25 backward, and the taper surface 25*i* is seated on the valve seat portion 26*a*.

The operation in the liquid cosmetic container 200 having the above-mentioned constitution will be described below. First, in the state that the operation portion 22 is not pressed from the outside, the taper surface 25*i* of the valve body 25 is in contact with the valve seat portion 26*a* of the valve seat member 26 by urging force of the spring member 27 and closes the opening 26*d*, and the valve body 25 is seated on the valve seat portion 26*a*.

Further, when a user presses the operation portion 22 from the outside, the valve body pressing portion 22*b* of the operation portion 22 is displaced to the inside due to the pressing, and the valve body pressing portion 22*b* presses the taper surface 25*g* of the enlarged diameter portion 25*f*. When the valve body pressing portion 22*b* presses the taper surface 25*g*, the enlarged diameter portion 25*f* of the valve body 25 is moved frontward with respect to the valve body pressing portion 22*b*. Further, the taper surface 25*i* departs from the valve seat portion 26*a* to open the opening 26*d*, and the valve body 25 is seated away from the valve seat portion 26*a*. Then, the liquid cosmetic L existing in the back delete of the valve seat portion 26*a* is moved frontward through a part between the valve seat portion 26*a* and the central portion 25*h* and a part between the enlarged diameter hole portion 26*g* and the head portion 25*e*, enters into the side of the holding member 8, and is supplied to the holding member 8 and the application body 4. Therefore, the liquid cosmetic L can be applied from the top end of the application body 4 in the same manner as the first exemplary embodiment. When the valve body 25 is moved, the enlarged diameter portion 25*f* of the valve body 25 is moved to the side of the valve seat portion 26*a*, so that the liquid cosmetic L between the valve seat portion 26*a* and the enlarged diameter portion 25*f* is pushed out toward the valve seat portion 26*a* in which the valve body 25 is seated away. Therefore, the liquid cosmetic L can be supplied more quickly.

Further, when a user cancels pressing the operation portion 22, the operation portion 22 returns to the original position by its elastic force. Then, due to the returning of the operation portion 22, the valve body 25 is moved backward according to the urging force of the spring member 27, the taper surface 25*i* is in contact with the valve seat member 26*a* and closes the opening 26*d*, and the valve body 25 is seated on the valve seat portion 26*a*. Therefore, supplying the liquid cosmetic L to the holding member 8 and the application body 4 is stopped in the same manner as the first exemplary embodiment.

According to the liquid cosmetic container 200 of this exemplary embodiment, when the operation portion 22 is pressed from the outside, the enlarged diameter portion 25*f* of the valve body 25 is moved to the side of the valve seat portion 26*a* by the valve body pressing portion 22*b*, and the liquid cosmetic L between the valve seat portion 26*a* and the enlarged diameter portion 25*f* is pushed out toward the valve seat portion 26*a* in which the valve body 25 is seated away. Therefore, the liquid cosmetic L can be supplied more quickly, and the liquid cosmetic container 200 can become a service condition easily.

Further, in the valve body 25, the bar-shaped member 25*a* and the enlarged diameter portion 25*f* are separated. Therefore, the enlarged diameter portion 25*f* is attached after the spring member 27 is inserted into the central portion 25*h* of the bar-shaped member 25*a*, so that the spring member 27 can be held easily between the valve body 25 and the valve seat member 26.

In addition, in the liquid cosmetic container 200 of the fourth exemplary embodiment, the application body 14 of the third exemplary embodiment can be used instead of the application body 4. Further, in the liquid cosmetic container 200, the inclination angle of the valve body pressing portion 22*b* may not be the same as the inclination angle of the taper surface 25*g*.

As described above, the present invention has been described in detail based on the exemplary embodiments. However, the present invention is not limited by the above exemplary embodiments. For example, the shapes of the valve body and the valve body pressing portion are not limited by the above exemplary embodiments. For example, a male screw or a female screw can be respectively formed on each taper surface of the valve body 5 and the valve pressing portion 6*h* and these screws can be screwed to each other. By pressing to the operation portion 2, the valve body 5 can be moved in the axial direction to the valve seat portion 6. Furthermore, instead of the taper portions 5*f* and 25*t*, for example, an ellipsoid body made of an elastic body in contact with the inner surface of operation portion 2 or 22 is provided, and the valve body can be moved in the axial direction by pressing to the operation portion 2 or 22.

Further, in the above exemplary embodiments, the application bodies 4 and 14 are a bundle of fibers and made of polyester. However, the types and the materials of the application body are not limited and, for example, a brush or a writing brush can be used.

EXPLANATION OF REFERENCE NUMERALS

1: Container body
1*a*: Storage portion
2, 22: Operation portion
4, 14: Application body
5, 25: Valve body
5*f*, 25*t*: Taper surface
5*g*: Taper surface
6*a*, 26*a*: Valve seat portion
6*h*, 22*b*: Valve body pressing portion
6*i*: Taper surface
7, 27: Spring member (elastic member)
25*f*: Enlarged portion
L: Liquid cosmetic

What is claimed is:

1. A liquid cosmetic container comprising:

an elongated container body comprising a storage portion adapted to store a liquid cosmetic;

an application body provided at a top end of the container body and adapted to allow application of liquid cosmetic;

a flow path connecting the application body and the storage portion of the container body, and adapted to allow liquid cosmetic to flow from the storage portion to the application body;

an operation portion provided on an elongated side surface of the container body and configured to be pressed from the outside of the elongated container body a valve seat member with a valve seat portion provided in the flow path of the container body;

a valve body adapted to be moveable in an axial direction in the valve seat member in the container body, and having an enlarged diameter portion, wherein said valve body is biased to close the flow path by seating on the valve seat portion, and open the flow path by moving away from the valve seat portion; and a valve body pressing portion adapted to make the valve body move in the axial direction so as to be away from the valve seat portion when the operation portion is pressed from the outside, wherein the valve body includes a front side shaft portion entering an opening portion of the valve seat portion, and a back side shaft portion formed in a substantially cylindrical shape and extending in an axial direction, and a hole portion provided in a spring supporting portion of the valve seat member, in which the back side shaft portion is inserted.

2. The liquid cosmetic container according to claim 1, wherein the valve body configured with a core portion with a taper portion as said enlarged diameter portion provided between said front side shaft portion and said back side shaft portion;

wherein pressing the operation portion from the outside, the valve body pressing portion moves the enlarged diameter portion in the direction departing from the valve seat portion, so that the valve body is moved away from the valve seat portion.

3. The liquid cosmetic container according to claim 2, wherein a spring member is provided in the container body and a front end of said spring member is fixed and supported at the back end of the taper portion and another end thereof is fixed and supported at the spring supporting portion of the valve seat member such that the valve body is urged in the direction so as to be seated on the valve seat portion by said spring member.

4. The liquid cosmetic container according to claim 2, wherein said valve seat member is provided with at a back end surface of the valve seat portion with arm members extending to a space in the back side in the axial direction; and at the back end of the arm members said valve body pressing portions are provided.

5. The liquid cosmetic container according to claim 2 or 4, wherein the taper portion inclines in the axial direction and being moved in the axial direction by pressing the operation portion.

6. The liquid cosmetic container according to claim 5, wherein the taper portion has a truncated cone shape, inclining in the axial direction, and wherein a contact surface of the valve body pressing portion to the valve body is a taper surface having the same inclination as the taper portion of the valve body.

7. The liquid cosmetic container according to anyone of claims 1 to 4, wherein the operation portion is made of an elastic material.

8. The liquid cosmetic container according to claim 1, wherein container body and the operation portion are integrally molded by two-color molding.

9. A liquid cosmetic container comprising:

An elongated container body comprising a storage portion at a first end thereof and adapted to store a liquid cosmetic;

an application body provided at a second end of the container body and adapted to apply liquid cosmetic;

a flow path connecting the application body and the storage portion of the container body, and adapted to allow liquid cosmetic to flow from the storage portion to the application body;

an operation portion provided on a side surface of the container body and configured to be pressed from the outside of the container body;

a valve seat member with a valve seat portion provided in the flow path in the container body;

a valve body adapted to move in an axial direction in the flow path in the container body, and provided with an enlarged diameter portion with a taper portion so as to make the diameter to gradually expand as going from the front end to the backside, wherein said valve body is biased to close the flow path by seating on the valve seat portion, and open the flow path by moving the valve body away from the valve seat portion; and a valve body pressing portion making the valve body to move in the axial direction so as to be away from the valve seat portion by pressing the operation portion from the outside, wherein the valve body includes a front side shaft portion entering an opening portion of the valve seat portion, and a back side shaft portion formed in a substantially cylindrical shape and extending in an axial direction, said taper portion is formed between the front side shat portion and the back side shaft portion, a hole portion is provided in a spring supporting portion of the valve seat member, in which the back side shaft portion is inserted, wherein by pressing on the operation portion, vale body press parts provided in the rear ends of arm members located on the valve seat member presses the taper part of the valve body, moving thereby the valve body backwards.

10. The liquid cosmetic container according to claim 9, wherein the operation portion is made of an elastic material.

11. The liquid cosmetic container according to claim 9, wherein container body and the operation portion are integrally molded by two-color molding.

12. The liquid cosmetic container according to claim 9, wherein the taper portion has a truncated cone shape, including in the axial direction, and wherein a contact surface of the valve body pressing portion to the valve body is a taper surface having the same inclination as the taper portion of the valve body.

13. The liquid cosmetic container according to claim 9, wherein a spring member is provided in the container body and a front end of said spring member is fixed and supported at the back end of the taper portion and another end thereof is fixed and supported at the spring supporting portion of the valve seat member such that the valve body is urged in the direction so as to be seated on the valve seat portion by said spring member.

* * * * *